US005368286A

United States Patent [19]

Horsman et al.

[11] Patent Number: 5,368,286

[45] Date of Patent: Nov. 29, 1994

[54] LABEL INSERTER FOR PACKAGING MACHINE

[75] Inventors: Dennis P. Horsman, Overland Park, Kans.; J. Scott Nixon, Independence, Mo.

[73] Assignee: Multivac, Inc., Kansas City, Mo.

[21] Appl. No.: 131,662

[22] Filed: Oct. 5, 1993

[51] Int. Cl.[5] ..... B65H 5/08

[52] U.S. Cl. ..... 271/11; 271/102; 271/104

[58] Field of Search ..... 271/11, 99, 102, 104

[56] References Cited

U.S. PATENT DOCUMENTS

| | | | |
|---|---|---|---|
| 2,657,049 | 10/1953 | Baker | 271/102 X |
| 3,797,822 | 3/1974 | Anderson | 271/99 |
| 4,418,906 | 12/1983 | Scott | 271/99 |
| 4,649,692 | 3/1987 | Tomosue | 271/99 X |
| 5,031,892 | 7/1991 | Stieger | 271/102 X |
| 5,161,791 | 11/1992 | Akiyama et al. | 271/104 X |

*Primary Examiner*—H. Grant Skaggs
*Assistant Examiner*—Carol L. Druzbick
*Attorney, Agent, or Firm*—Shook, Hardy & Bacon

[57] ABSTRACT

A sheet placer for use in conjunction with a packaging machine to minimize space along the machine for moving sheets from a supply in a magazine to receptacles moved by the machine. The placer has vertically oriented magazines and suction cup assemblies which move on a vertical path of travel between sheet pick up positions and sheet releasing positions. The assemblies are carried by a block mounted on a vertical track and operated by an air motor. A cam and follower mechanism moves a slide horizontally to cause a rack and pinion arrangement to reverse by the orientation of the vacuum cup assemblies during each up or down movement of the assemblies by the air motor.

11 Claims, 3 Drawing Sheets

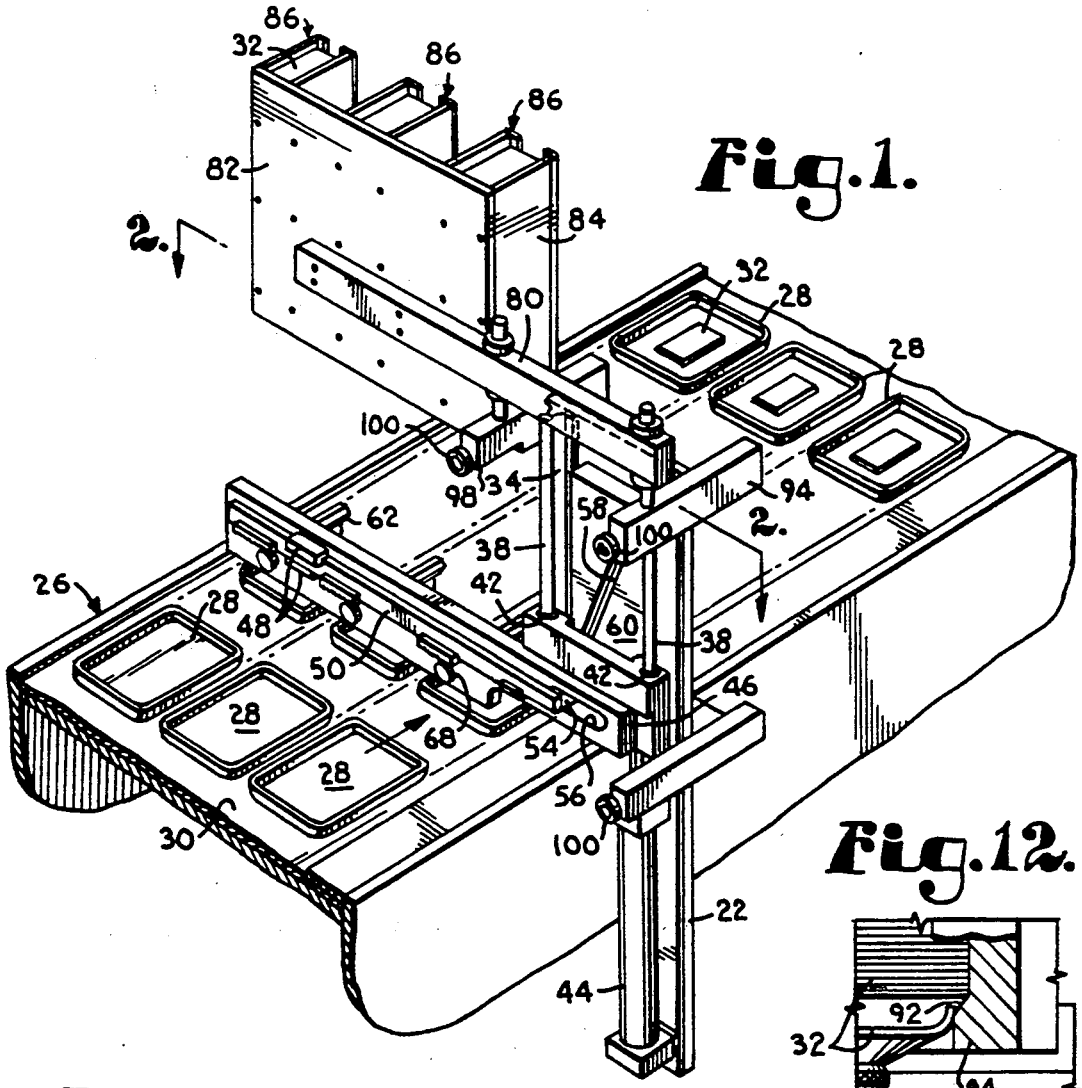
Fig. 1.
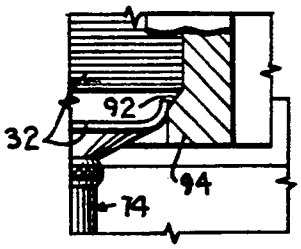
Fig. 12.
Fig. 2.
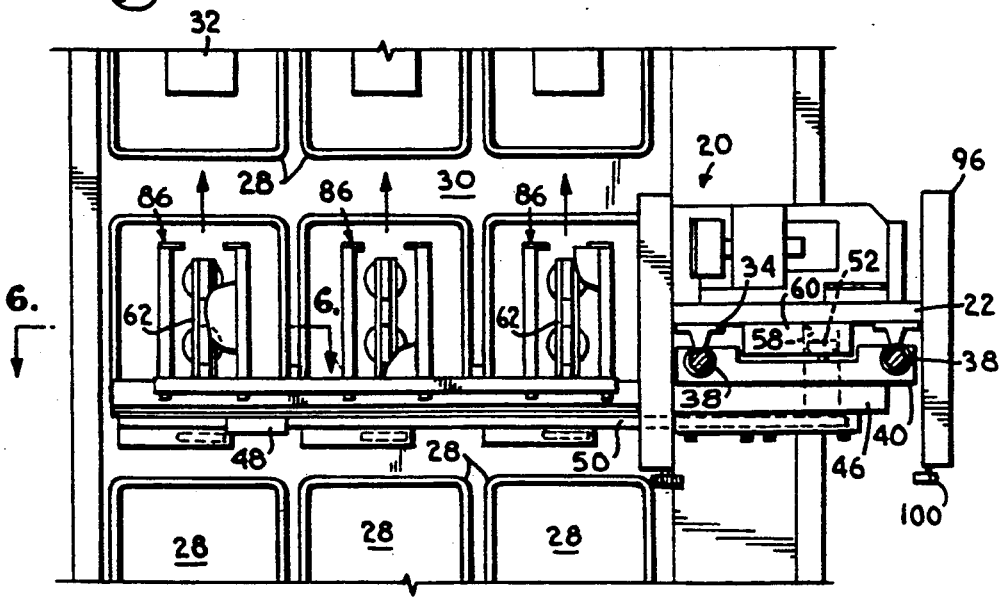

Fig.5.
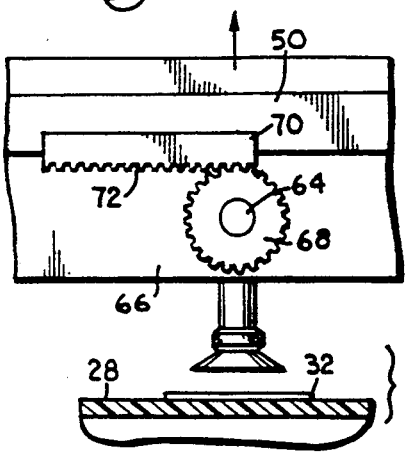
Fig.8.
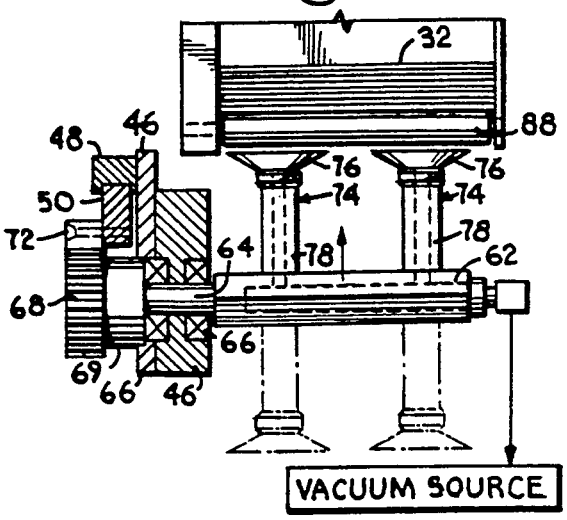
Fig.6.
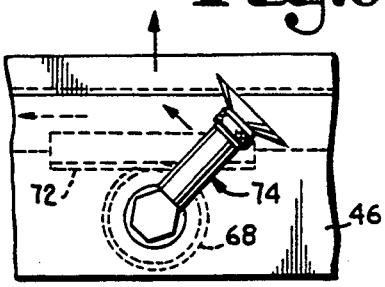
Fig.9.
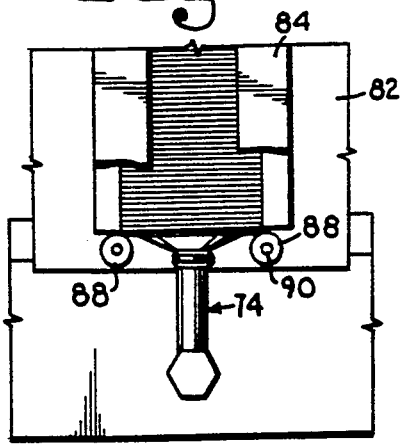
Fig.7.
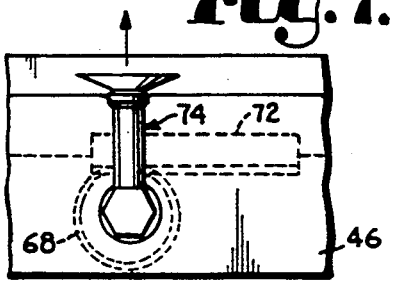
Fig.11.
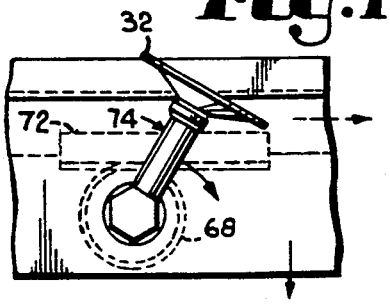
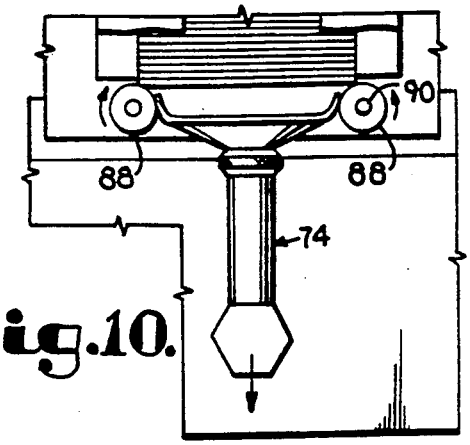
Fig.10.

LABEL INSERTER FOR PACKAGING MACHINE

This invention relates to packaging equipment, and more particularly to a novel apparatus for placing notices or other sheet material items at specific locations in conjunction with the operation of a packaging machine.

Packaging machines of the type commonly employed in the food industry and in other industries typically form packages from a continuous web of packaging material and the packages are filled and closed as they are advanced through the machine. It is often desirable to place labels or notices into the packages before they are closed. Such notices generally may be printed on sheets of paper, plastic or the like which are automatically placed into each package by high speed vacuum cup equipment capable of removing single sheets from stacks of such sheets in magazines, and then placing the removed sheets where required, such as into its corresponding packages. Also, sheets of folded cartons or the like are commonly moved by vacuum cup apparatus from a supply thereof to the place where they are filled with a product in connection with the operation of some types of packaging machines.

A disadvantage with heretofore available sheet placers has been the relatively great amount of space required for such apparatus. Packaging machines often perform a substantial number of functions, including forming the article receptacles and eventually covering the receptacles and sealing the packages. For carton handling machines, sheets from which cartons are formed are unfolded and sometimes glued or otherwise secured in carton configuration. Articles to be packaged must be placed into the receptacles before the packages or cartons are closed and sealed. Accordingly space along the path of travel of the receptacles as they are moved through the packaging machine is quite limited.

A stock of the sheet items to be placed by the placer apparatus is kept in stacks in magazines from which the sheets may be individually removed by suction cup equipment. These magazines are conventionally disposed at an angle above the web of package forming material. The suction cups are typically swung through accurate paths of travel between the magazines and the receptacles into which the sheets are deposited. Space must be provided for the angled magazines and for swing of the cups and this further reduces the precious space required for package forming and filling operations.

Accordingly, it is a primary object of the present invention to provide sheet material placing apparatus for a packaging machine which substantially minimizes the space required for moving the sheets from the supply magazines to the packages.

In the achievement of the foregoing object, it is another object of the invention to provide packaging machine sheet placing apparatus which minimizes the space required by operating in generally vertically oriented, reciprocating travel over the path of movement of the package receptacles through the packaging machine.

A further object of this invention is to provide sheet placing apparatus which occupies a minimum amount of space yet which may be readily constructed to accommodate any desired number of rows of packages as may be required to be produced by the machine.

Yet another important aim of this invention is to provide apparatus of this type which is durably constructed and which is capable of relatively high speed automated operation without the need for substantial operator attention.

These and other important aims and objectives of this invention will be further explained or will become apparent from the following description and explanation of the drawings.

In the drawings:

FIG. 1 is a perspective view of label placer apparatus embodying the principles of this invention, a packaging machine with which the placer is used being shown fragmentally;

FIG. 2 is a detailed cross-sectional view taken along line 2—2 of FIG. 1;

FIG. 5 is an enlarged, fragmentary front elevational view of the apparatus of FIG. 3 showing the rack and pinion operator for one suction cup assembly;

FIG. 6 is an enlarged, detailed fragmentary cross-sectional view taken along line 6—6 of FIG. 2;

FIG. 7 is a view similar to FIG. 6 but showing the suction cup further rotated to its upwardly facing position;

FIG. 8 is an enlarged, detailed cross-sectional view taken along line 8—8 of FIG. 4, the downwardly facing position of the suction cup being shown in broken lines;

FIG. 9 is an enlarged, fragmentary front elevational view of the apparatus showing a suction cup assembly in position to pick up an insert from the magazine corresponding to the assembly, parts being broken away to reveal details of construction;

FIG. 10 is a view similar to FIG. 9 on a still further enlarged scale showing an insert being drawn from the magazine by the suction cup assembly;

FIG. 11 is a view similar to FIG. 6 but showing the assembly carrying an insert toward the place of deposit in a package receptacle; and FIG. 12 is a fragmentary view similar to FIG. 10 but showing an alternate form of arcuate sheet retainer for the magazine in place of the roller sheet retainers shown in FIGS. 3 and 8–10.

Figure 3:
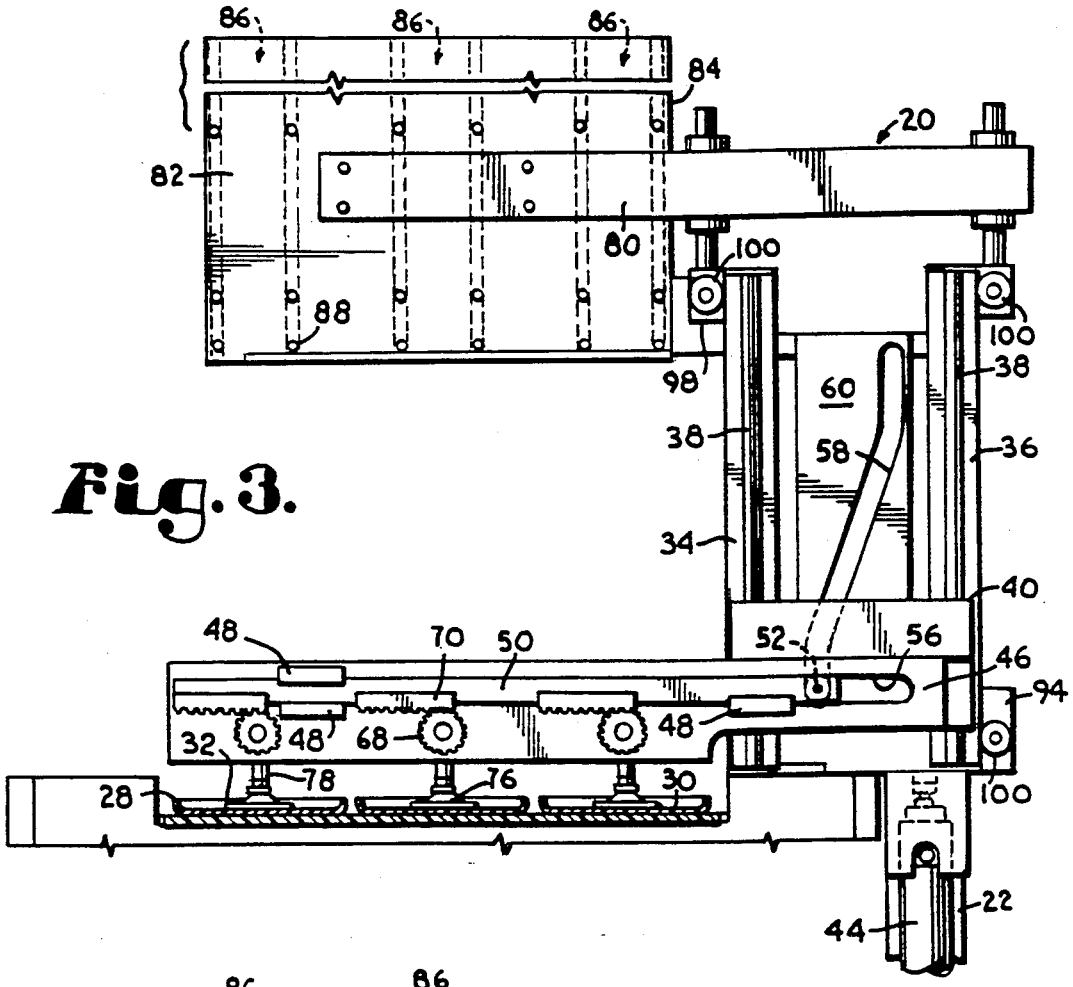
FIG. 3 is a front elevational view of the placer showing the apparatus in position to deposit inserts.

Sheet placing apparatus embodying the principles of this invention is broadly designated in the drawings by the reference numeral 20. Apparatus 20 includes a substantially upright, rigid base plate 22 secured by suitable mounting structure proximal the side 24 of a packaging machine 26. Machine 26 may be of a type which forms a plurality of packages 28 from a web 30 of packaging material and advances the packages in the direction of the arrow shown in FIG. 2 through a loading zone or station adjacent apparatus 20. In the particular instance illustrated in the drawing, packaging machine 26 forms successive rows of three packages per row disposed in side by side fashion. The rows are advanced through the loading station where items to be packaged are loaded into the respective packages for subsequent closing and sealing of the package by the machine.

Apparatus 20 chosen for illustration in this application is particularly designed for placing an insert 32 in each package which moves through the packaging machine. Insert 32 could be any kind of sheet material such as a label listing various data pertaining to food products as is required by government regulation for packaged products of this kind.

Plate 22 supports a pair of vertically extending, parallel rails 34 and 36 which are secured to plate 22 and are configured with integral, substantially transversely circular outwardly projecting ribs 38. Preferably, rails 34 and 36 are of identical construction and the cross-sectional configuration of the rails can best be seen in FIG. 2 of the drawing.

A block 40 having a pair of spaced apart, parallel extending, semicircular apertures which contain semicircular bushings 42 through which are received the corresponding ribs 38 as shown in FIG. 2. Block 40 is thereby mounted on the track formed by the ribs for vertical sliding movement on the ribs. Means to reciprocate block 40 up and down along the track comprises a motor 44 which may be an air motor operably coupled with a source of compressed air (not shown).

Figure 4:
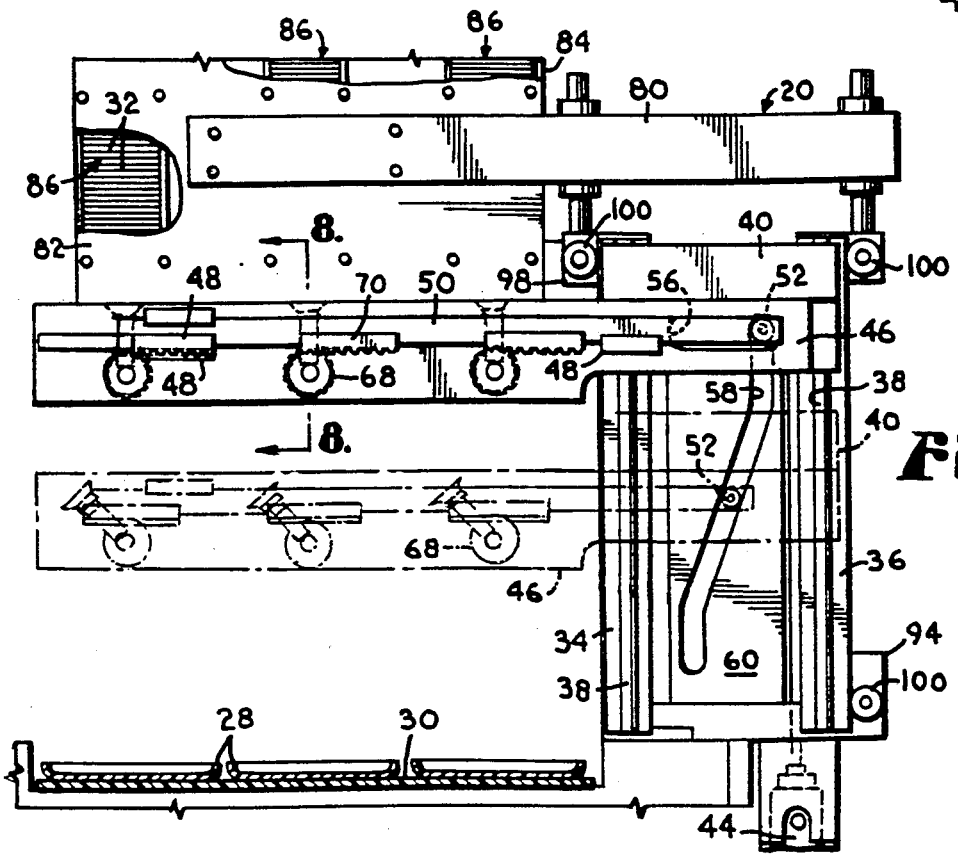
FIG. 4 is a fragmentary view similar to FIG. 3 but showing the apparatus in position to pick up inserts from the magazines, an intermediate position of the apparatus being shown in broken lines, parts of the magazine being broken away to reveal details of construction.

An elongated rigid bar 46 is rigidly secured to block 40 and cantilevers outwardly therefrom across the packaging machine above the rows of packages 28 as the latter are advanced through the machine. Bar 46 carries a plurality of spaced apart, oppositely facing guides 48 configured to receive an elongated, rigid, preferably transversely rectangular slide 50 and confine the slide to reciprocating movement longitudinally of bar 46. Means to reciprocate slide 50 includes a roller 52 carried at the end of an arm 54 secured to one end of slide 50 as best seen in FIG. 2 of the drawing. Arm 54 projects through an elongated opening 56 in bar 46 as shown in FIGS. 1, 3 and 4 of the drawing.

Roller 52 is received in an elongated irregularly shaped slot 58 formed in the face of a plate 60 which is secured to plate 22. Slot 58 is preferably shaped as shown in the drawings and serves as a cam which cooperates with a follower in the form of roller 52 to move slide 50 back and forth longitudinally of bar 46 as the latter is carried by block 40 up and down the track by the operation of motor 44.

A plurality of shafts 62 are mounted for rotation on bar 46 and project from the downstream side of bar 46 as shown best in FIG. 8 of the drawing. Each shaft 62 has a portion 64 of reduced diameter which is received in suitable bearings 66 carried by bar 46. A pinion gear 68 for each shaft respectively is rigidly secured to the portion 64 of each shaft which projects from bar 46 on the side of the latter proximal slide 50. A spacer 69 on each portion 64 between the gear 68 and bar 46 holds the gear spaced outwardly from the bar as shown in FIG. 8. Spacers 69 may be integral with their corresponding gears or, if desired, may be separate therefrom.

Preferably bar 46 is provided with a shaft for each column of advancing trays to be accommodated by the machine. Since packaging machine 26 is designed to accommodate three packages advancing in side by side columns through the machine, bar 46 is provided with three shafts 62, there being a shaft for each column respectively. An elongated rack 70 having a toothed edge 72 is provided for each pinion 68 respectively. The racks 70 are secured to slide 50 proximal to one operably engaged with their corresponding pinion gears so that movement of slide 50 by the inter-engagement of roller 52 in cam slot 58 causes rotation of the gears. The relationships of the components are such that the respective shafts 62 are rotated 180° during each movement of block 40 between the respective ends of its path of travel.

In the preferred embodiment of apparatus 20, a pair of preferably identical suction cup assemblies 74 are mounted on each shaft 62 as best shown in FIG. 8. Assemblies 74 include suction cups 76 mounted on the ends of elongated, rigid conduits 78 projecting from the shaft. The cups are carried by their respective conduits during rotation of the shafts.

Assemblies 74 may be of conventional construction and are provided with internal ducting or other means for operably connecting the cups 76 with a suitable source of vacuum 75 when required and for terminating the communication of the vacuum to the suction cup when that is required, as will be subsequently explained. The construction and operation of apparatus for supplying and interrupting negative pressure to vacuum cup assemblies of this type in connection with placing apparatus is well known in the art, is not claimed as the invention per se, and need not be shown or described herein. It suffices to say that the ducting for supplying the negative pressure to the suction cups might desirably be provided in the form of internal canals 79 in the components described herein to minimize any need for auxiliary piping and the like. Further, suitable valving 81 might be provided for operation by the movement of the components described. Such apparatus is well known, is within the ability of those reasonably skilled in the art and is not detailed herein.

An elongated, rigid member 80 is mounted on plate 22 and extends in cantilevered fashion in general parallelism above bar 46 as shown in the drawings. A plate 82 is mounted on bar 80 and supports three pairs of substantially identical, mutually spaced apart sides 84 arranged to provide three identical magazines 86, each being adapted to contain sheet items in the nature of the inserts 32 to be placed by apparatus 20. It should be noted that magazines 86 are oriented substantially vertically and they overlie the respective shafts 62 so that the suction cup assemblies 74 are in disposition to operably contact the stack of items in their respective magazine when the bar 46 is moved to the uppermost end of its path of travel by air motor 44.

The magazines 86 may be of conventional construction. The embodiments of the magazines chosen for illustration are substantially conventional with the exception of the means used for holding the sheets of materials in the magazines. An elongated roller 88 mounted for rotation about an elongated shaft 90 carried by the magazine backplate 82 and sides 84 is provided on each side of the magazine adjacent the bottom outlet opening thereof. The outer surface of each roller 88 projects slightly inwardly of the outlet opening towards the opposite roller as shown in the drawings. The rollers project beneath the proximal edges of the stack to hold the stack in position in its respective magazine. However, the rollers readily permit the removal of the lowermost one of the sheets from the stack as is illustrated generally in FIG. 10 of the drawing.

It has been found that elongated rollers at two side edges of a magazine for sheet material of this type serves better than the pawls, pins or projections conventionally used for this purpose. It is theorized that the arcuate outer surface of the rollers combined with the turning movement of the rollers which takes place as the sheet of material is withdrawn from the magazines accounts for the improved performance. The stack of sheets is securely maintained in the magazine against gravitation therefrom by the rollers but a single lowermost sheet can be readily removed from the magazine without dislodging other sheets. Manifestly, the shafts 90 might be mounted for adjustment toward or away from one another if desired to accommodate any particular weight or dimension of the sheets to be accommodated by the apparatus.

An alternate embodiment of magazine retainer is illustrated in FIG. 12. An arcuate surface 92 on a shoulder of a retainer 94 retains the stack in the magazine but permits a single sheet 32 to be removed therefrom. It is contemplated that an identical member 94 be provided on the opposite side of the magazine and the members 94 could be of whatever size might be required. Each member 94 would present an arcuate shoulder 92 extending along one edge of the respective sheets and projecting into the outlet opening of a magazine to releasibly retain the sheets in position yet permit the removal of a single sheet from the bottom of the stack. The arcuate surface 92 serves substantially the same function as the arcuate outer surface of rollers 88. Neither the rollers 88 nor the arcuate surfaces 92 need necessarily extend uninterruptedly the full length of the proximal edge of the sheets. Instead, if desired, or for certain items to be handled by the apparatus, the rollers or arcuate surfaces might be provided at spaced intervals along the edge to be supported.

It is contemplated that a cover (not shown) might be provided around apparatus 20 if desired. A plurality of substantially parallel members 94 and 96 are mounted on plate 22 and a similar member 98 is mounted on bar 80 as shown in the drawings. The members 94–98 are provided for supporting a cover which might be secured to the member by fasteners 100 or the like. The relatively short lengths of the members 94–98 demonstrate the space conserved by the principles of this invention. The cover to be supported by these members defines the length of apparatus 20 longitudinally of the packaging machine. The inserts 32 are picked up from the magazines and placed into the containers by components which operate entirely within this length.

In the operation of apparatus 20, a supply of sheet items such as inserts 32 are provided in each of the magazines 86. Negative air pressure is operably coupled to assemblies 74 as heretofore explained. Similarly, a source of operating air pressure is supplied to motor 44 as will be readily understood. Valving equipment of the type commonly used with placing apparatus for packaging machines is associated with the positive and negative air pressure and operates in timed sequence with the package forming operations of the packaging machine.

Air motor 44 is operated to advance block 40 to the uppermost end of its path of travel. Roller 52 follows in slot 58 during the upward movement of the block and shifts slide 50 to the right as seen in FIG. 1 of the drawing. This moves the racks 70 to rotate the corresponding pinions 68 and shafts 62 in the direction to bring the assemblies 74 to the full upright position before the block 46 reaches the uppermost end of its path of travel. Conversely, movement of block 46 downwardly by motor 44 causes the slide to be shifted in the opposite direction and rotates the assemblies 74 to their downwardly facing positions before they reach the bottom of their respective paths of travel.

The shape of slot 58 is chosen with substantially vertical segments at each end of the slot interconnected by a diagonal portion of the slot. This provides for an increment of substantially vertical movement of the assemblies 74 without further rotation at the extreme ends of their paths of travel. This allows the cups to be moved vertically into flat engagement with a sheet in the magazine to effect a firm suction grip on the sheet and withdrawal of the sheet vertically from the magazine to allow the sheet to clear the magazine before the reversal of the assembly begins. It also allows movement of the cups vertically into and out of the packages at the bottom of the path of travel. Reversal of the direction of extension of the assemblies 74 occurs intermediate the movement of the assemblies vertically without rotational movement.

Each assembly 74 is moved into engagement with the bottommost sheet in its respective magazine. Negative air pressure is applied to each suction cup 76 to releasibly attach the lowermost sheet to its corresponding cup. Motor 44 is reversed to move block 40 toward the lowermost end of its path of travel. This reverses the direction of extension of the assembly 74. The operation of the machine is synchronized so that a row of partially formed packages or receptacles is disposed beneath the assemblies as they reach the lowermost ends of their paths of travel. The negative air pressure is removed from the suction cups 76 when in this position to release the sheets 32 and deposit the latter in the respective receptacles.

After the sheets have been deposited in a row of receptacles, the air motor is reversed to move block 40 upwardly to obtain the next sheets from the magazines. The apparatus operates automatically and sequentially in the manner heretofore described in timed sequence with the advancement of the receptacles through the machine to place a sheet in each receptacle as required.

The movement of the vacuum cup assembly 74 by block 40 is limited to a vertical path of travel. As has been pointed out this insures that the space occupied by the operation of apparatus 20 in performing its role of placing sheets in the receptacles is kept to an absolute minimum. This assures that space needed for other operations such as those for filling the receptacles prior to closing the packages is available along the machine.

While apparatus 20 has been described in connection with the placement of sheets such as informational inserts into the receptacles, it will be readily understood that the principles of the invention are also applicable to other sheet placing functions. For example, a placer for moving sheets to be utilized in the formation of cartons or the like could be advantageously constructed for operation in a minimum amount of space by use of the principles of this invention. The terms "package" and "packaging machine" as used herein should be understood to also embrace cartons and machines for forming cartons. The term "sheet" may include a sheet attached to other sheets as, for example, a part of a carton.

Modifications can, of course, be made to apparatus 20 without departing from the spirit of the invention for example means other than a cam and follower device could be used to operate slide 50 and reverse the positions of the suction cup assemblies. A fluid motor or other transducer could be used instead. For that matter, any of a variety of rotation devices could be operably attached directly to the assemblies and operated through suitable controls to change the positions of the assemblies. Space is conserved to the maximum if the assemblies are moved substantially vertically between the pick up and release positions and this may be carried out in several different ways.

Having thus described the invention, I claim:

1. For use with a packaging machine which moves a series of at least partially formed packages arranged in at least one now along a path of movement through a loading zone, apparatus for removing sheets of material from a supply thereof and depositing the sheets at a desired location relative to said series of packages, said apparatus comprising:

a plurality of suction cup assemblies, each having at least one suction cup carried by its respective rotatable shaft, said shafts extending generally parallel to said path of movement and each including a corresponding pinion secured to its shaft for rotation therewith, said assemblies overlying said zone and including means for applying suction to said cups for picking up and holding said sheets, and means for interrupting the suction to the cups for causing the sheets to be dropped by the cups;

means operably coupled with the suction cup assemblies for moving the latter on reciprocating paths of travel extending substantially vertically between an uppermost position proximal said sheet supply with each cup in disposition for picking up a sheet therefrom, and a lowermost position proximal a package when said package is in the zone with each cup in disposition for depositing the sheet at said desired location, said path of reciprocating travel being substantial normal to said path of movement; and shifting means operably coupled to said moving means and to said assembly for rotating said cup from upwardly facing at said uppermost position to downwardly facing at said lowermost position responsive to said moving means, said shifting means including a rack cantilevered across said row of said packages at said zone and operably engaged with each of said pinions, a cam and follower mechanism operably coupled to said rack and being further operably coupled to said moving means, whereby as said moving means reciprocates said assembly between said uppermost position and said lowermost position, the cam and follower longitudinally shifts the rack thereby rotating the pinions which moves the cups from upwardly facing at the uppermost position to downwardly facing at the lowermost position.

2. Apparatus as set forth in claim 1, said supply including a plurality of sheet containing magazines, there being a suction cup assembly for each magazine, respectively.

3. A method of simultaneously placing a plurality of sheets of material from a like number of supplies of said sheets to a like number of packages arranged in side-by-side rows and moving along a path of movement through a loading zone, said method comprising:

moving a plurality of carrier assemblies supported on a common bar cantilevered over one row of said side-by-side rows at located said zone transversely across said path of movement through a substantially vertical path of travel above the row to a position proximal said supplies of said sheets;

releasably attaching one of said sheets from each supply to a respective assembly;

moving the plurality of said assemblies each with its respective sheet attached thereto through a substantially vertical path of travel to a location proximal said row; and releasing the sheet from each of said plurality of said assemblies while said assemblies are proximal said row, whereby movement of the plurality of assemblies through said substantially vertical path of travel minimizes the space required for performing said method.

4. A method as set forth in claim 3, wherein each assembly of said plurality of assemblies includes at least one suction cup, and wherein said sheet is releasably attached to the suction cup by applying a vacuum to the cup.

5. A method as set forth in claim 4, wherein each assembly of said plurality of assemblies includes a plurality of suction cups.

6. A method as set forth in claim 5, wherein the suction cup of each assembly of said plurality of assemblies is positioned in a first direction to face toward the respective supply of sheets when the cup is proximal the supply, and wherein the method includes the step of reversing said direction of the cup when the plurality of assemblies is moved toward said row while keeping the cup in a fixed, substantially upright plane.

7. A method as set forth in claim 6, wherein the row of packages advances along a path of travel through the loading zone, and wherein the cup direction is reversed by swinging the cup about an axis which extends generally parallel with the path of advance of the row.

8. For use with a packaging machine which moves packages arranged in side-by-side rows along a path of movement through a loading zone, apparatus for removing a plurality of sheets of material from a like number of respective supplies thereof and depositing the sheets simultaneously on one row of said side-by-side rows of packages located at said zone, said apparatus comprising:

a plurality of assemblies, each having at least one suction cup, said assemblies being supported on a rigid common bar cantilevered over said row transversely to said path of travel and including a means for applying suction to each said cup for picking up and holding said sheets, and means for interrupting the suction to the cups for causing the sheets to be dropped by the cups;

said supplies including magazine means for each assembly adapted to contain sheets above said assembly;

moving means for reciprocatingly moving the assemblies on a path of travel extending substantially vertically between an uppermost position proximal said magazine means, and a lowermost position proximal said loading zone; and shifting means operably coupled to said moving means and to said assemblies for rotating said cups from upwardly facing at said uppermost position and downwardly facing at said lowermost position.

9. The apparatus of claim 8, wherein said cup of each assembly of said plurality of assemblies is carried by a respective corresponding rotatable shaft, each shaft including a pinion secured to the shaft for rotation therewith.

10. The apparatus of claim 9, wherein said shifting means comprises a rack cantilevered across said row of said packages at said zone and operably engaged with said pinion of each assembly of said plurality of assemblies, a cam and follower mechanism operably coupled to said rack and to said moving means, whereby as said moving means reciprocates said plurality of assemblies from said uppermost position to said lowermost position, the cam and follower mechanism reciprocatingly longitudinally shifts the rack thereby rotating said cups from upwardly facing at the uppermost position to downwardly facing at the lowermost position.

11. The apparatus of claim 8 wherein said assemblies are mounted on said common bar for movement of the assemblies in plane substantially normal to said path of movement of said packages to minimize space required by said apparatus.

* * * * *

UNITED STATES PATENT AND TRADEMARK OFFICE

CERTIFICATE OF CORRECTION

PATENT NO. : 5,368,286

DATED : November 29, 1994

INVENTOR(S) : Dennis P. Horsman and J. Scott Nixon

It is certified that error appears in the above-indentified patent and that said Letters Patent is hereby corrected as shown below:

Delete Figure 8, and substitute therefor the Figure , consisting of Fig. 8, as shown on the attached page.

Signed and Sealed this

Twenty-fifth Day of April, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,368,286

DATED : November 29, 1994

INVENTOR(S) : Dennis P. Horsman and J. Scott Nixon

It is certified that error appears in the above-indentified patent and that said Letters Patent is hereby corrected as shown below:

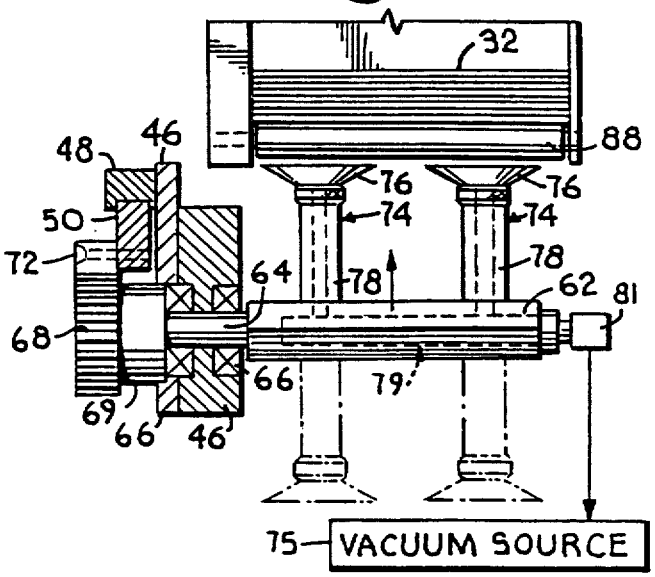

Fig.8.